US005269043A

United States Patent [19]

Yang

[11] Patent Number: 5,269,043

[45] Date of Patent: Dec. 14, 1993

[54] PNEUMATIC HINGE

[76] Inventor: Ming-Hua Yang, No. 44-1, Lane 215, Chungkang Rd., Hsinchuang, Taipeihsien, Taiwan

[21] Appl. No.: 917,395

[22] Filed: Jul. 23, 1992

[51] Int. Cl.[5] ..... E05F 3/20

[52] U.S. Cl. ..... 16/68

[58] Field of Search ..... 16/68

[56] References Cited

U.S. PATENT DOCUMENTS 1,253,882 1/1918 Pilson ..... 16/68

1,282,419 10/1918 Hawkins ..... 16/68

*Primary Examiner*—Lowell A. Larson

*Assistant Examiner*—Carmine Cuda

*Attorney, Agent, or Firm*—Bacon & Thomas

[57] ABSTRACT

The invention is a pneumatic hinge which makes use of the air pressure action and counter balance to produce a spring-free hinge structuring to improve the ability to interrupt an opening or closing door at one's disposal of the traditional spring hinge, to eliminate its disadvantage as well as to produce more practical value.

5 Claims, 7 Drawing Sheets

PNEUMATIC HINGE

BACKGROUND OF INVENTION

Hidden hinges of many types and shapes are widely applied to hinge doors (both wooden and glass) of cupboards. As shown in FIG. 1, the structure of the many hinges is but a base saddled) with a hollow opening(11) that contains a group of plates(2) with folding actions by which a link(3) connected to the plates(2) and a base saddle(4) can be foldedly-turned within a 90°. The application of the structure is to fix the base saddled) on the door plate and attach the base saddle(4) to the cupboard, so that the action of the plates(2) and link(3) can open and shut the door within a right angle. Yet, in order to shut the door firmly, a contraction spring(5) is usually equipped on the joint of plates(2) and link(3) of most hinges. Despite that the contraction of the spring(5) shall hold the door tight against the cupboard or shut it automatically, the installation of the spring is that inconvenient and time consuming, and as the contraction is strong, it sometimes pushes the door to the cupboard which that makes so loud a noise and even damages the door or the glass door, the losses both countable and uncountable of hidden hinges would somewhat degrade their value of application.

SUMMARY OF INVENTION

The structure of a pneumatic hinge is a spring free hidden hinge making use of the repeated action of the link and plates to pull a coupling and an action plate to activate the air capsules equipped on the hollow opening of hinge to contract or expand so that the door fitted on it can be easily opened or closed upon an application of slight force. In addition, in order to stabilize a door in action and balance the action and reaction forces gained from the air capsules, two groups of the air capsules are designed as dampers for the hinge to control its action and reaction forces so that the door can be held at any motion which that is one of its special features.

DETAILED DESCRIPTION OF THE PREFERRED EMBODIMENT

Figure 1:
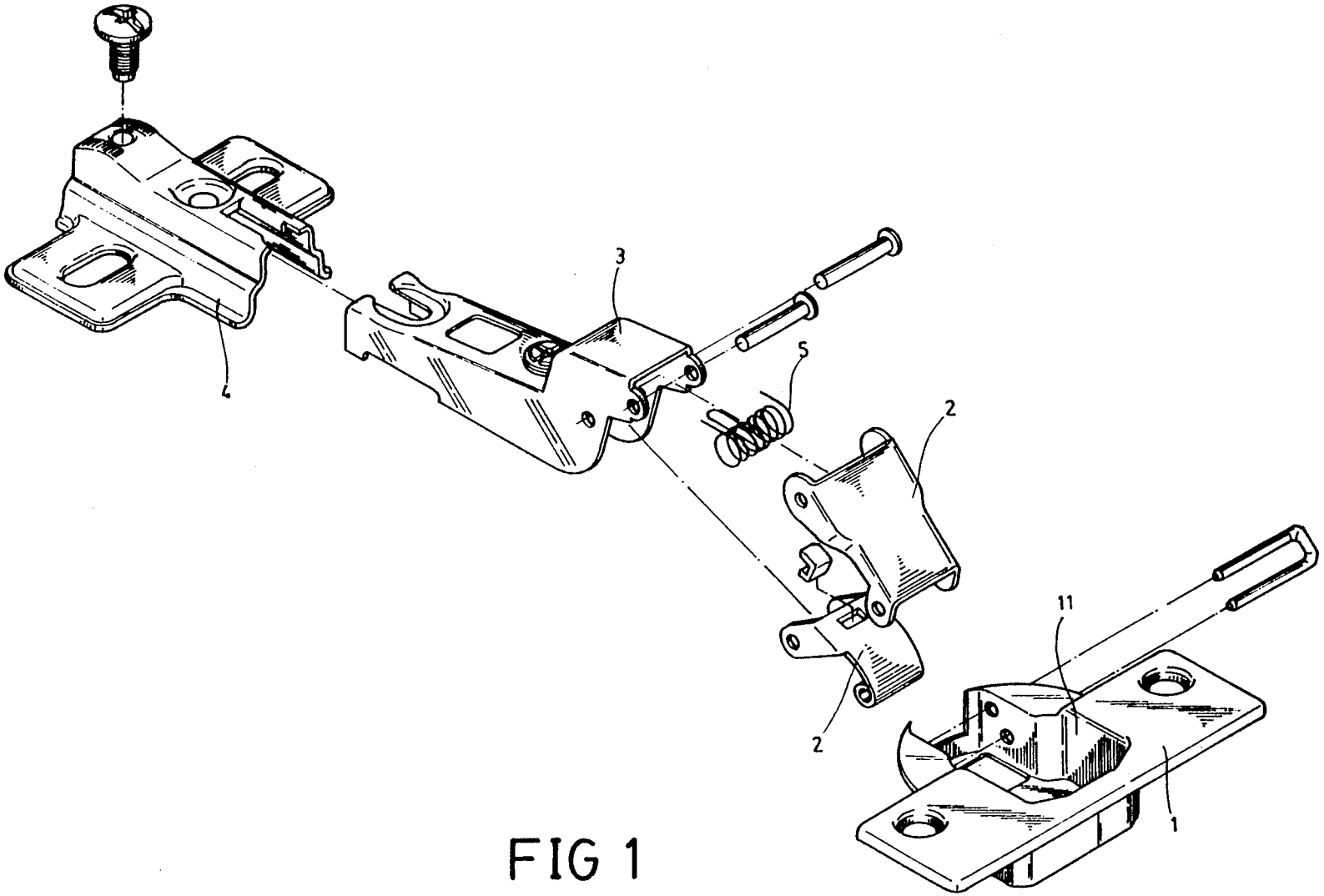
FIG 1 (prior art)
FIG. 1 is the structural drawing of an ordinary hidden spring hinge.
Figure 2:
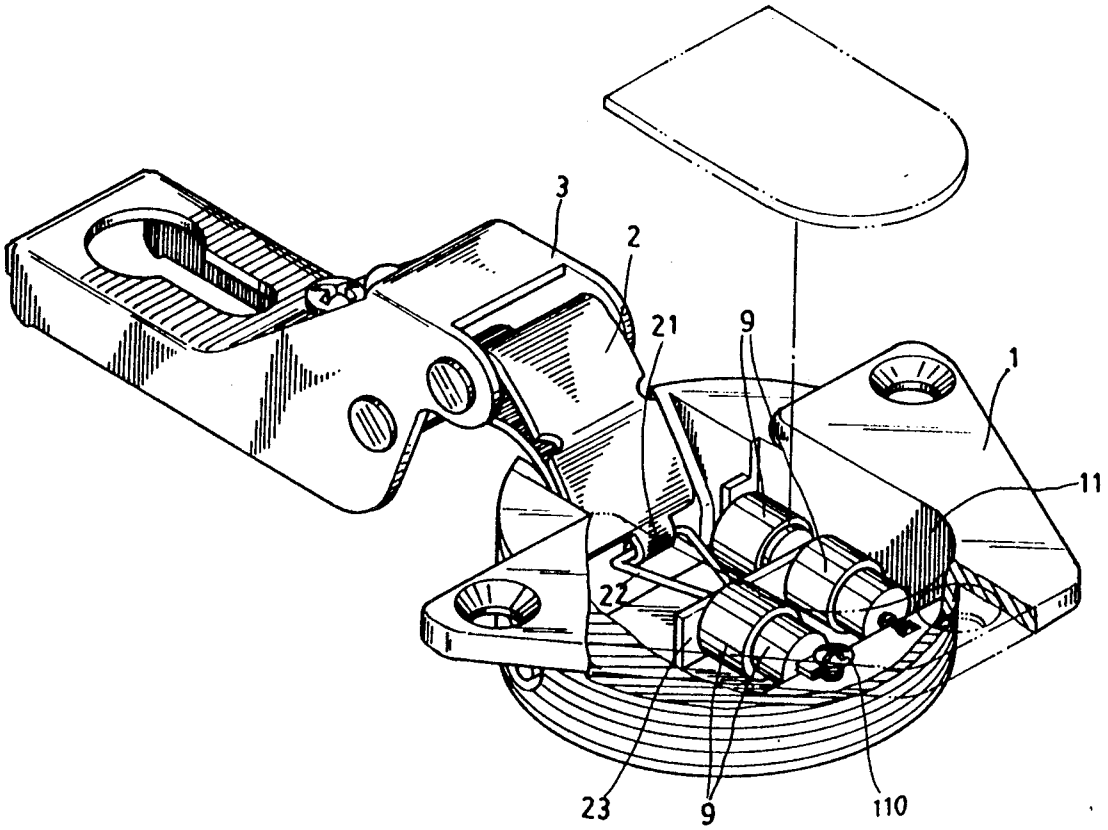
FIG. 2 is a 3-D drawing of the invention.
Figure 3:
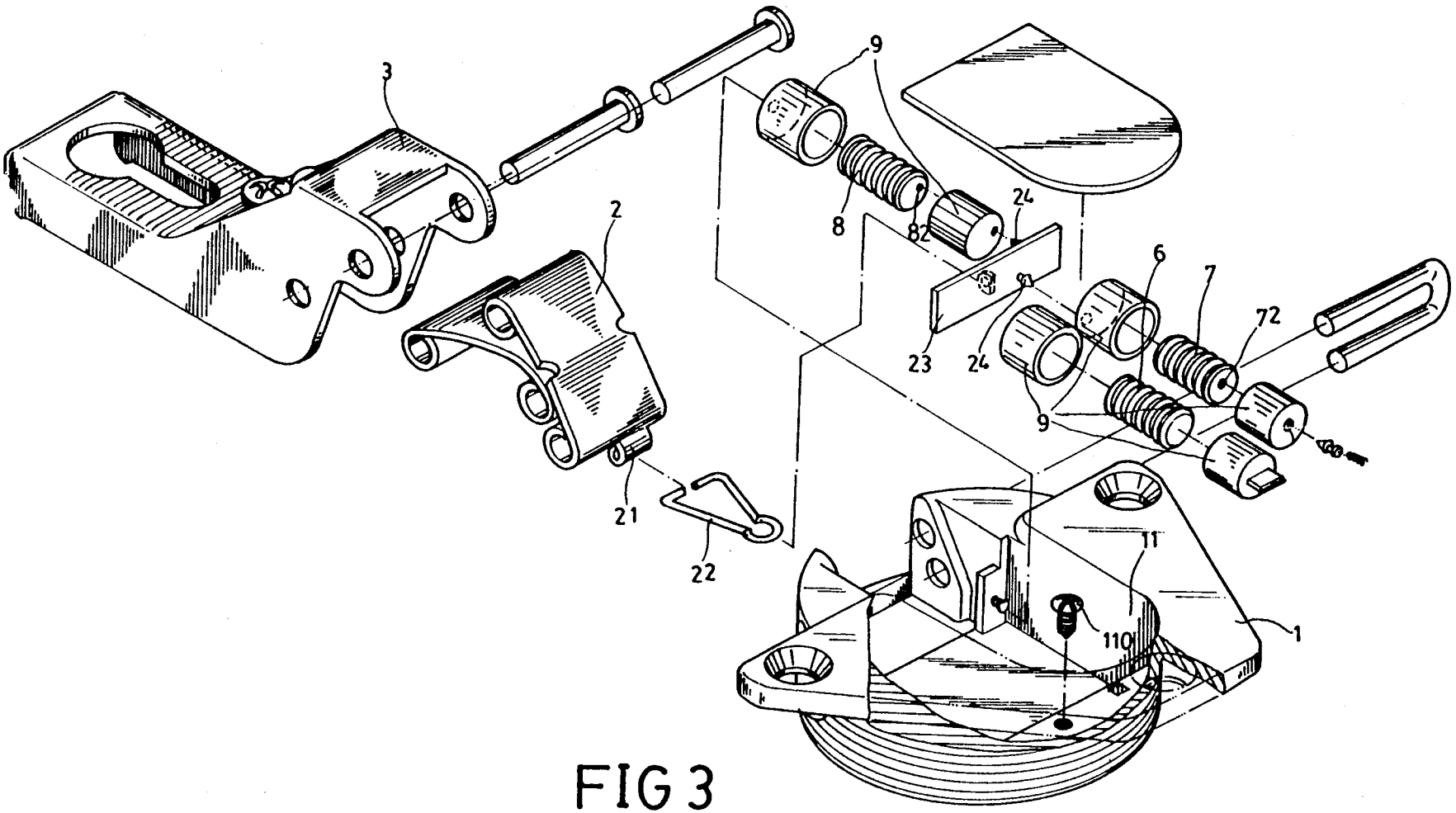
FIG. 3 is the structural drawing of the invention.

Refer to FIGS. 2 and 3, the invention is a spring-free pneumatic hinge structuring which makes use of air pressure to open, shut or keep a door half-open. In the middle of the bottom, where connected the link(3) and plates(2), of the hollow opening(l 1) of the base saddled), a coupling saddle(21) is connected to a coupling(22) whose other end is hinged to a tracker action plate(23) whose forward and backward actions shall pull the coupling(22) and saddle(21) to make the plate (2) turn within an axle. There are air capsule A(6) and air capsule B(7) on the other side of the coupling(22) and action plate (23), and an air capsule C(8) is equipped next to the coupling corresponding to capsuleB(7). These three are high quality sealed elastic capsules filled with non-toxic gas and individually kept in three U-shape movable cabinets(9) amongst which capsule A(6) shall produce reaction force after being contracted. However, as capsule B(7) and C(8) contain one-way inlet valves(71) and (81) and one-way exhaust valves (72) and (82) respectively, they can be instantly inflated and exhausted when appropriate force is applied. In addition to these valves, two stoppers(24) are equipped on the both sides of the action plate(23) to control the inflation and exhaustion of either capsules so that a counter-balance shall be gained when the action plate(23) remains idle. Moreover, a sharp end screw is provided to control the air pressure of capsule A(6) by tightening or releasing from the pressure adjustment holed 10) to size the cabinet(9).

To assemble the hinge, place the plates(2) that contains the coupling saddle(21) on the hollow opening(11) of the base saddled(1), connect the coupling(22) and the action plate(23) respectively to the coupling saddle(21), install capsule A(6), B(7) and C(8) in position, and adjust the air pressure of capsule A(6) by the adjustment holed 1 0) to complete the assembly. Now that the hinge is ready for use, it is to fix the base saddle (1) on the door (both wooden or glass) and the base saddle(4) on the cupboard respectively, connect them by the link(3) and adjust air pressure of capsule A(6).

Figure 4B:
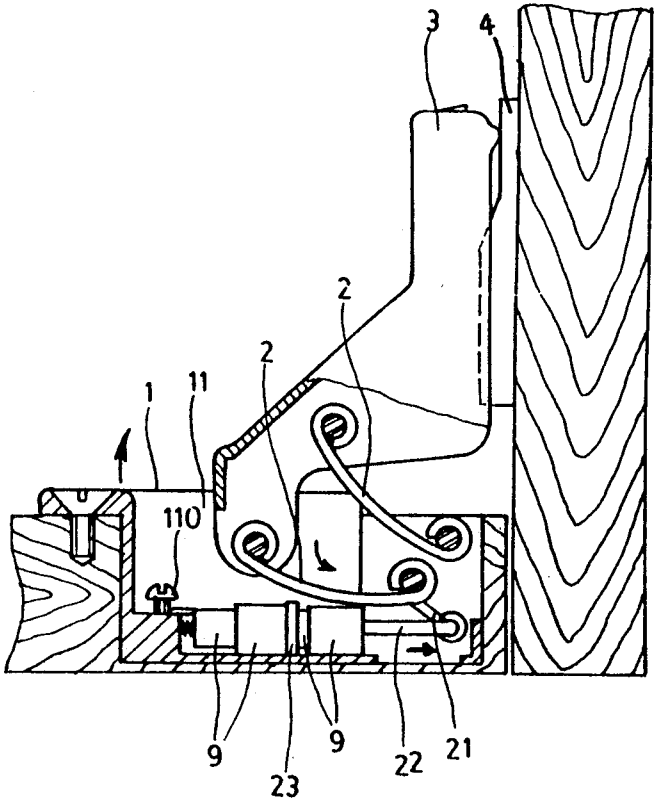
FIG. 4 is the structural illustration of the invention that is idle.
Figure 4A:
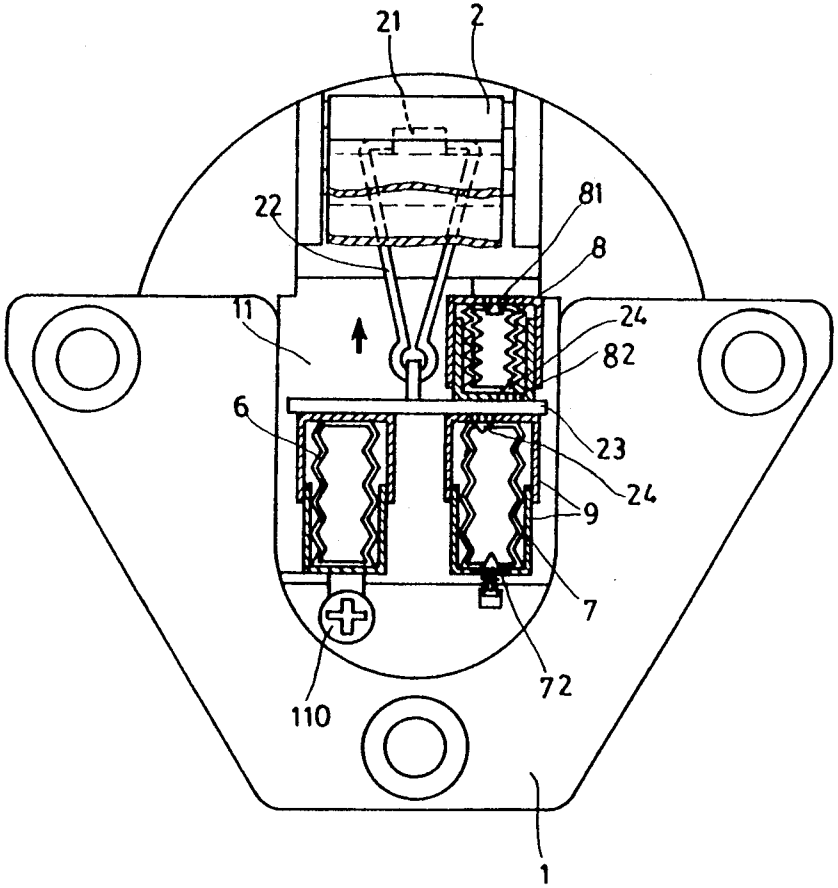
Figure 5B:
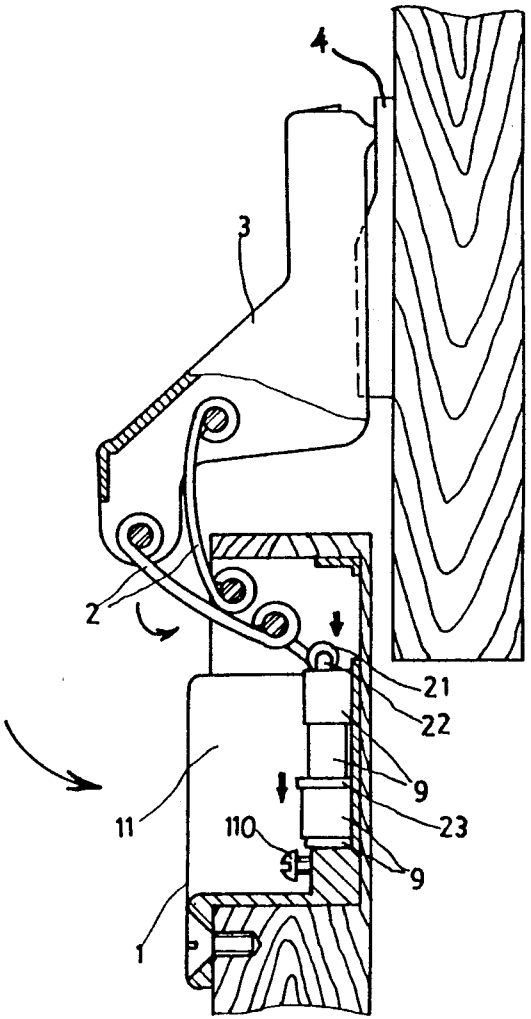
FIG. 5 is the structural illustration of the invention after the door is opened.
Figure 5A:
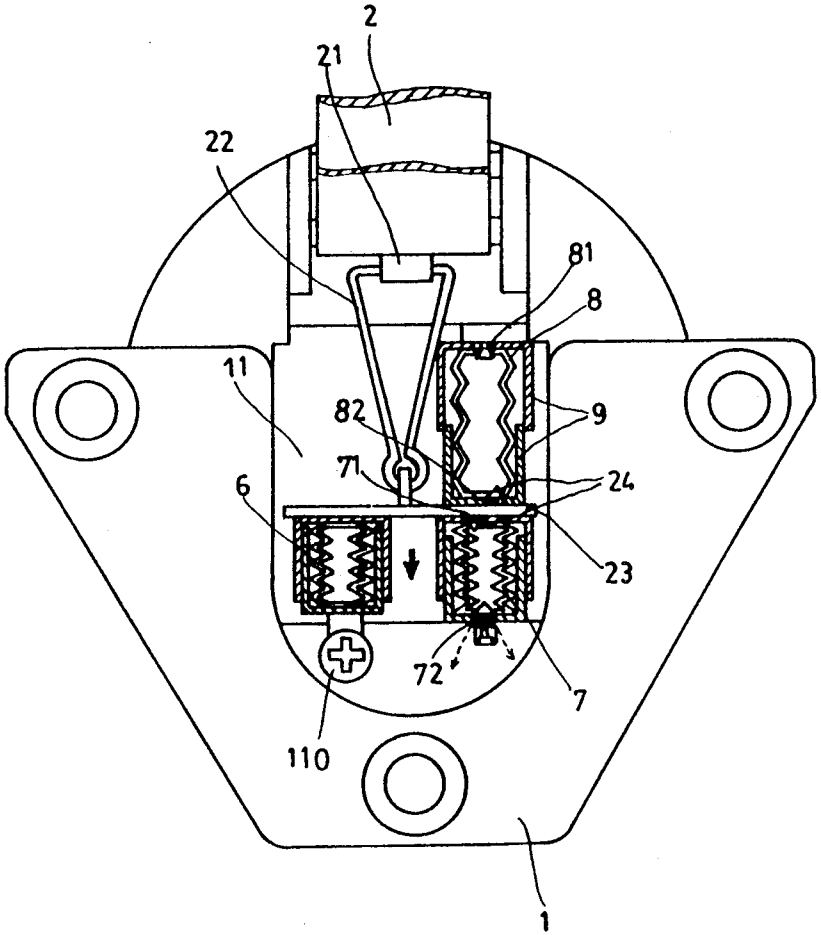
Figure 6B:
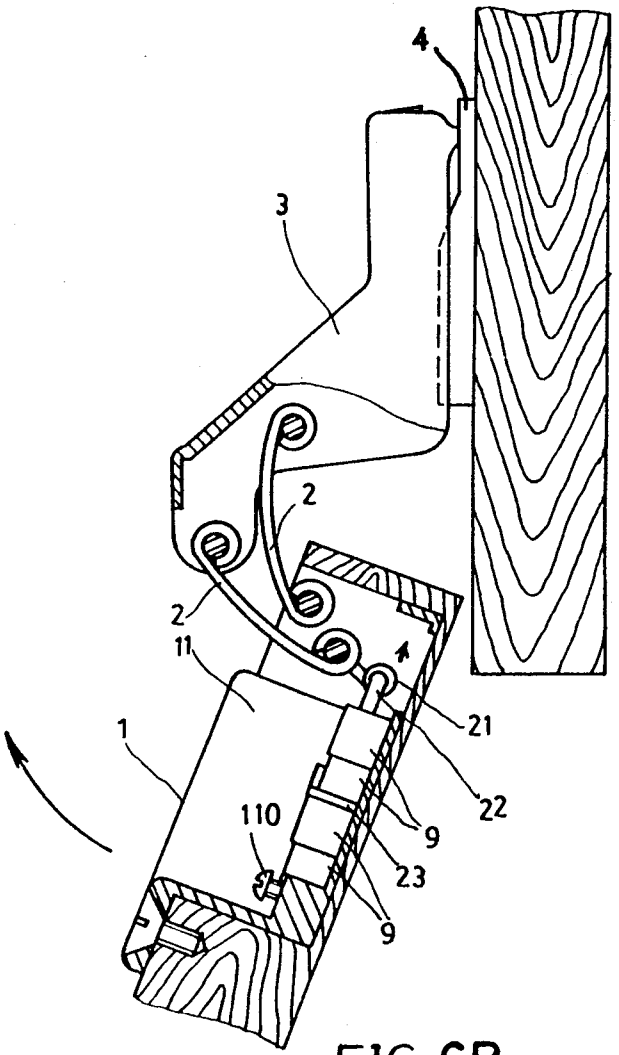
FIG. 6 is the structural illustration of the invention when the door is shut.
Figure 6A:
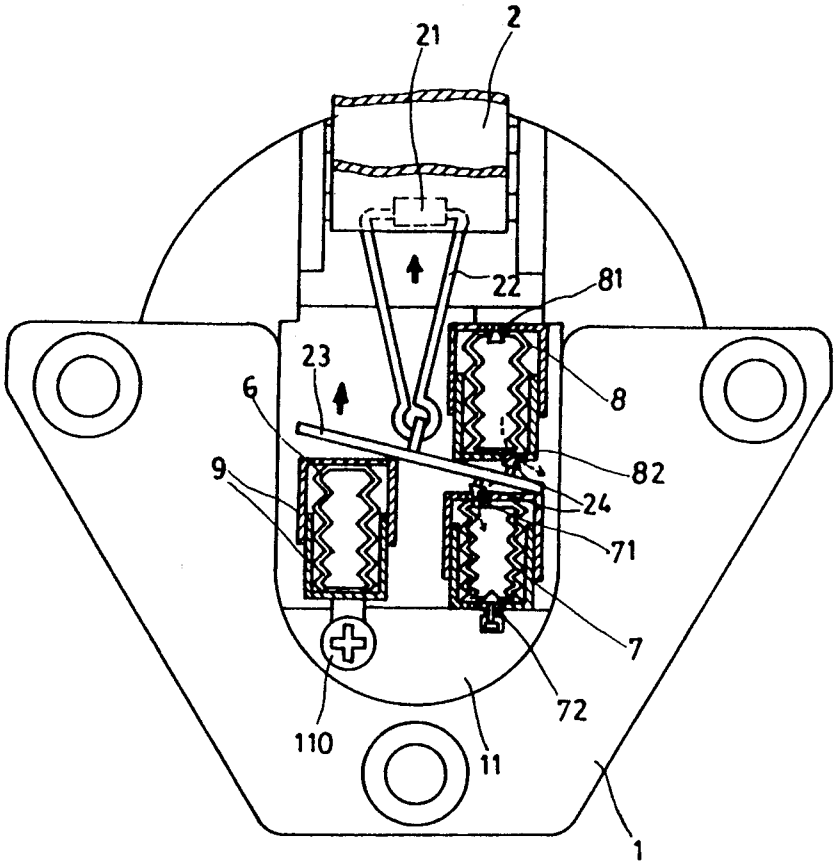
Figure 7B:
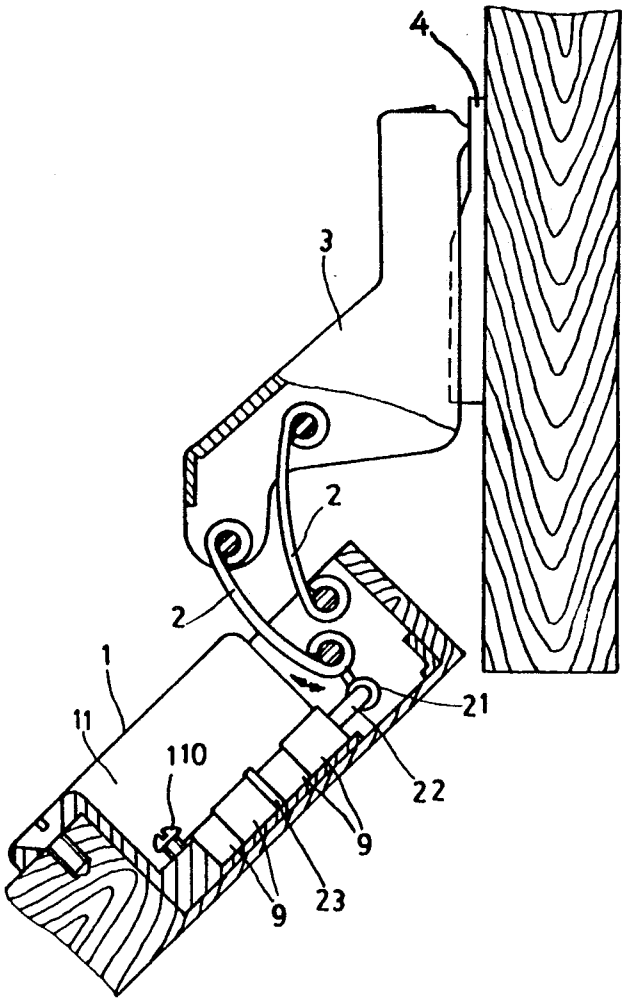
FIG. 7 is the structural illustration of the invention when the door is half-opened.
Figure 7A:
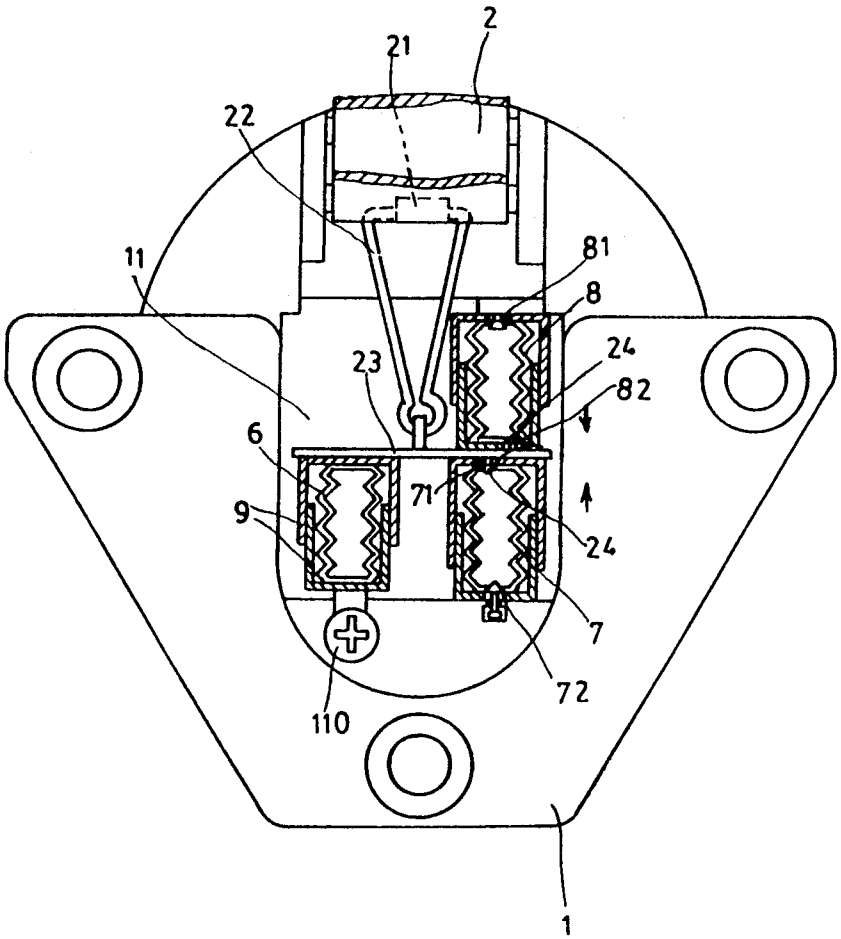

As shown in FIG. 4, when the door is shut, coupling saddle(21) is pushed to the very outside due to the turn of plates(2) and pulls the coupling(22) and the action plate(23) backward so that both the capsules A(6) and B(7) remain idle while capsule C(8) is contracted by the backward movement of action plate(23). Although capsule A(6) has not yet been contracted, the constant pressure makes it push against the action plate (23) and coupling(22) which, through the connection to the coupling saddle(21), thrust the plates(2) to keep the door shut. When the door is open, the base saddled) is extended which that turns the plates(2) inside and pulls the coupling(22) by the coupling saddle(21). Being pulled by the coupling(22), the action plate(23) pushes against capsule A(6) and B(7) as shown in FIG. 5. Having pushed by the action plate(23), the size of capsule A(6) becomes smaller but the inside pressure increases as capacity decreases; whereas, having the air exhausted from the exhaust valve(72), capsule B(7) becomes smaller both in size and pressure. To capsule C(8), as the action plate(23) is pushed to another side and releases from contracting it, air is inflated through the inlet valve(81) as capsule C(8) expands itself by the original elasticity. The expansion of capsule C(8) and contraction of capsule B(7) maintain a counter-balance for the action plate(23) which pushes the door widely opened. The door shall be interrupted in the middle of the action (half-open), as the counterbalance maintained by the expanded capsule C(8) and the contracted capsule B(7) regardless to the reaction force that might be produced from the pressured capsule A(6). To shut an open door, just apply a slight force to the door so that the plates(2) shall be in action to pull the coupling(22) and action plate(23) connected by the coupling saddle(21). At this moment, the action plate(23) moves inversely and releases from contracting capsule A(6) and B(7), and capsule A(6) expands and produces reaction force to push the action plate(23) and the coupling(22) that pull the plates(2) to turn again to shut the door as shown in FIG. 6. And at the same time when the reaction force of capsule A(6) pushes the action plate(23), as the pressure of capsule A(6) is greater than that of capsule B(7), the action plate(23) is pushed oblique and the two stoppers(24) on both sides are released from sealing either valves so that capsule B(7) is inflated instantly and expands rapidly, and on the other hand, as the one-way exhaust valve(82) of capsule C(8) is open and that it is contracted by the action plate(23), the air inside exhausts and the counter-balance pressure becomes ineffective which that makes the door shut by the reaction force gained from capsule A(6). However, as interruption is applied upon a closing door, the reaction force of capsule A(6) is hindered, and the instant inflation and exhaustion of capsules B(7) and C(8) can maintain a counter-balance immediately and pushes the action plate(23) return to normal position so that the door can be half-open again at one's disposal as shown in FIG. 7. And as slight force is applied to either direction again, the door shall either shut or open with the same action mentioned above through which one shall see how the advantages of the pneumatic hinge that traditional spring hinged shall never have.

The aim of the invention is thus to provide a kind of pneumatic hinge whose simple structuring shall be a spring-free action that improves the disadvantages of the traditional spring hinges so that one can interrupt an opening or closing door at one's disposal more easily, in order to satisfy the psychological needs of consumers.

The second aim of the invention is the use of action and reaction forces of air capsules gained from the contraction and release by the action plate activated by a curved plate so that the hinge can be folded with a right angle; and at the same moment, the counter-balance produced by the corresponding air capsules shall interrupt an opening or closing door at one's disposal making it half-open which that produces innovatory and practical values to hinges.

I claim:

1. A pneumatic hinge structure for pivotally supporting a movable element on a fixed element, comprising:

a) a first base portion fixedly attached to one of the movable and fixed elements;

b) a second base portion fixedly attached to the other of the movable and fixed elements;

c) a link member attached to the second base portion;

d) pivot attachment means pivotally connecting the first base portion to the link member;

e) an action plate operatively associated with the pivot attachment means such that pivoting motion of the movable element relative to the link member causes movement of the action plate relative to the first base portion;

f) a first pneumatic capsule operatively associated with the action plate and the first base portion so as to exert a force on the action plate urging the movable element toward a predetermined position; and, g) counter-balancing pneumatic capsule means operatively associated with the action plate and the first base portion so as to counter balance the force exerted on the action plate by the first pneumatic capsule in the absence of external forces applied to the movable element such that the movable element will remain in any position until an external force is applied thereto.

2. The pneumatic hinge structure of claim 1 wherein the action plate has opposite sides and wherein the counter-balancing pneumatic capsule means comprises:

a) a second pneumatic capsule operatively associated with a first side of the action plate and the first base portion; and, b) a third pneumatic capsule operatively associated with an opposite side of the action plate and the first base portion.

3. The pneumatic hinge structure of claim 2 further comprising valve means operatively associated with the second and third pneumatic capsules.

4. The pneumatic hinge structure hinge structure of claim 3 wherein the valve means comprises:

a) valve openings defined by the second and third pneumatic capsules; and, b) valve elements located on the action plate so as to engage the valve openings.

5. The pneumatic hinge structure of claim 4 wherein the pivot attachment means comprises:

a) a first pivot plate pivotally interconnecting the link member and the first base portion;

b) a second pivot plate pivotally attached to the link member; and, c) a coupling member attached to the second pivot plate and the action plate.

* * * * *